US005426922A

United States Patent [19]

Bott et al.

[11] Patent Number: 5,426,922

[45] Date of Patent: Jun. 27, 1995

[54] BOTTLE BAGGING APPARATUS

[75] Inventors: Jerry A. Bott, Grand Rapids; Floyd W. Butler, Allendale, both of Mich.

[73] Assignee: Ideas in Motion, Inc., Grand Rapids, Mich.

[21] Appl. No.: 871,073

[22] Filed: Apr. 20, 1992

[51] Int. Cl.[6] ..... B65B 9/13

[52] U.S. Cl. ..... 53/567; 53/284; 53/284.7; 53/495; 53/543

[58] Field of Search ..... 53/48.1, 48.2, 48.3, 53/48.4, 48.5, 48.6, 48.7, 75, 247, 252, 284.7, 448, 459, 469, 495, 496, 500, 543, 567, 570, 249, 250, 284, 468, 381.1, 384.1

[56] References Cited

U.S. PATENT DOCUMENTS

| | | | |
|---|---|---|---|
| 2,575,220 | 11/1951 | Hiller | 198/32 |
| 2,587,959 | 3/1952 | Biner | 198/32 |
| 2,633,280 | 3/1953 | Davies | 226/14 |
| 2,847,806 | 8/1958 | Wang | 53/567 X |
| 3,058,273 | 10/1962 | Forman et al. | 53/469 |
| 3,179,231 | 4/1965 | Craig | 198/32 |
| 3,360,901 | 1/1968 | Gallo | 53/567 |
| 3,481,107 | 12/1969 | Andblad et al. | 53/543 |
| 3,662,514 | 5/1972 | Goss | 53/567 X |
| 3,731,452 | 5/1973 | Rias | 53/567 X |
| 3,916,769 | 11/1975 | Turunen | 53/567 X |
| 3,926,322 | 12/1975 | Scott | 214/305 |
| 4,041,674 | 8/1977 | Reid | 53/496 |
| 4,214,419 | 7/1980 | Allen et al. | 53/543 |
| 4,231,697 | 11/1980 | Franz | 414/37 |
| 4,419,854 | 12/1983 | Okada et al. | 53/459 X |
| 4,457,123 | 7/1984 | Hoehn | 53/492 |
| 4,545,181 | 10/1985 | Frankefort | 53/459 |
| 4,672,872 | 6/1987 | Kuehnert | 83/171 |
| 4,730,437 | 5/1988 | Benno | 53/459 X |
| 4,765,121 | 8/1988 | Konstantin et al. | 53/459 X |
| 4,771,510 | 9/1988 | Kawai | 53/567 X |
| 4,848,065 | 7/1989 | Bott | 53/48 |
| 4,976,090 | 12/1990 | Porter et al. | 53/448 |
| 5,009,632 | 4/1991 | Kruessel | 53/567 X |
| 5,016,420 | 5/1991 | Chiappe et al. | 53/567 X |
| 5,069,594 | 12/1991 | Bott et al. | 414/412 |

FOREIGN PATENT DOCUMENTS

| | | | |
|---|---|---|---|
| 1359286 | 5/1964 | France | 53/459 |
| 2087338 | 5/1982 | United Kingdom | 53/459 |

*Primary Examiner*—John Sipos
*Assistant Examiner*—David Moon
*Attorney, Agent, or Firm*—Warner Norcross & Judd

[57] ABSTRACT

An apparatus for collecting, arranging and bagging a matrix of bottles. The apparatus includes a collecting platform upon which bottles are arranged into a matrix. A bagging station is adjacent to the collection platform. Adjacent the end of the bagging station opposite the collection station is a mechanism for grasping and opening a continuous sleeve. A pusher is provided to push the matrix of bottles into the open end of the sleeve. A sealing/cutter mechansim seals both ends of the filled sleeve and severs the formed bag from the continuous sleeve stock.

39 Claims, 11 Drawing Sheets

BOTTLE BAGGING APPARATUS

BACKGROUND OF THE INVENTION

1. Field of the Invention

The present invention relates to an apparatus for collecting bottles and bagging them.

2. Description of the Related Art

In the production of bottled goods, the bottles are often purchased in bagged lots which must be opened and fed one-by-one into the bottling stream. Bagged lots of bottles and an apparatus for unbagging them and feeding them into the bottling stream are shown in U.S. Pat. No. 5,069,594, issued Dec. 3, 1991. The bagged lot is typically formed as a single layer of bottles which are arranged into a square or rectangular matrix. The grouped bottles are encased in a plastic bag, the open end of which has been closed by heat sealing or the like. The closing of the bag creates a sealed flap on one end which may be used to open the bag.

Typically, automated bottling facilities fill bottles at high speed in large volumes. To provide the large numbers of bottles, the bottles are usually produced by high speed automatic apparatus such as blow molding machinery. Consequently, the great numbers of bottles produced must be bagged rapidly, efficiently, and economically to be passed on to the bottling facility.

SUMMARY OF THE INVENTION

The present invention satisfies the aformentioned criteria by providing apparatus which automatically collects bottles, arranges the bottles into square or rectangular matrix lots, bags the lots, and discharges the bagged lots for storage and subsequent transport to the bottling facility.

The apparatus includes a collection station which receives a series of individual bottles. The bottles are collected upon a collection platform in a single file row until the row length is the same as the length of the matrix of bottles to be bagged in a lot. When a full row has been collected, a reciprocating pusher bar moves the row across the platform then returns to receive another row. Rows of bottles continue to be collected and pushed across the platform until a complete lot of bottles in a rectangular matrix has accumulated on the platform.

The collection station is placed adjacent to one end of a bagging station. The bagging station includes a bagging table at approximately the same level as the collection platform arranged so that the lot of bottles on the collection platform may be pushed from the collection platform on to the bagging table.

Adjacent the end of the bagging station opposite the collection station there is a mechanism for unrolling and feeding a roll of a continuous plastic sleeve. In roll form, the sleeve is initially collapsed as a flat strip. The apparatus of the invention includes a device for continuously uncollapsing the sleeve as it is unrolled. In a preferred embodiment, this device includes a wedge shape spreader which is supported in a floating arrangement on rollers. These rollers hold the spreader frame in position with respect the bagging station to allow the plastic sleeve to completely surround the spreader and be drawn past the spreader. The spreader frame holds the opened end of the plastic sleeve in position to be drawn across the bagging table.

The bagging station includes a pair of graspers which are mounted above the bagging table for reciprocating motion toward and away from the spreader. The graspers have hands which are inserted into the sides of the open end of the plastic sleeve at the spreader as the graspers move toward the spreader. The graspers further include grippers and fingers which pinch the end of the plastic sleeve. Once the open end of the bag is grasped in this manner, the graspers retreat from the spreader by a distance to draw a length of plastic sleeve over the bagging table sufficient to form a bag for the lot of bottles on the collection platform.

The bagging station further includes a reciprocating lip bar extending across the bagging table near the collection platform. As the graspers are drawing a length of plastic sleeve toward the collection platform, the lip bar is raised. When the graspers have moved fully toward the collection platform, the lower extent of the open end of the plastic sleeve is disposed beneath the lip bar. The lip bar is then lowered to draw the lower extent of the open end of the plastic sleeve downward. This increases the height of the sleeve opening and forms a smooth table surface on which the lot of bottles may slide.

With the plastic sleeve drawn across the bagging table by the graspers and the lower extent of the sleeve opening held down by the lip bar, the lot of bottles on the collection platform is pushed by a second pusher bar through the open end of the sleeve until the entire lot is within the sleeve.

A first pair of sealing jaws is provided across the bagging table near and in front of the lip bar. After the lot of bottles has been pushed into the sleeve, the lip bar raises and the grasper releases while the first pair of sealing jaws come together to clamp the open end of the plastic sleeve and form a first heat-sealed flap. A second pair of sealing jaws is provided across the bagging table near and in front of the spreader. The second pair of sealing jaws comes together to clamp the plastic sleeve between the lot of bottles and the spreader and form a heat seal. A hot wire cutter is also provided which moves across the sleeve outwardly of the second pair of sealing jaws to sever the sleeve and form a second flap opposite the first flap. Thus, a bag is formed from a section of the sleeve with the lot of bottles enclosed therein. Conveyors on the bagging table then move the bagged lot laterally off the bagging table to an unloading station.

The cutting of the sleeve forms a new free end of the sleeve just forward of the spreader in readiness to be grasped and drawn by the graspers. A second lot of bottles is collected in a matrix on the collection platform in readiness to be pushed into the next section of sleeve to be drawn by the graspers.

These and other objects, advantages, and features of the present invention will be more fully understood and appreciated by reference to the written specification and appended drawings.

DESCRIPTION OF THE PREFERRED EMBODIMENT

Figure 1:
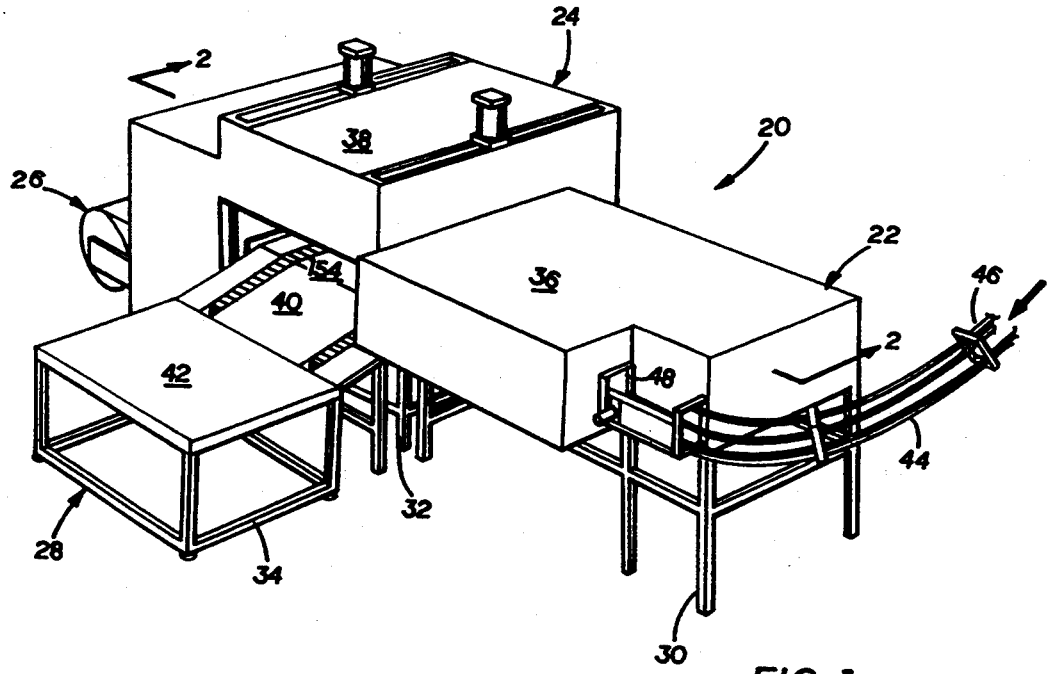
FIG. 1 is a perspective view of a bottle bagging apparatus according to the principles of the invention.
Figure 2:
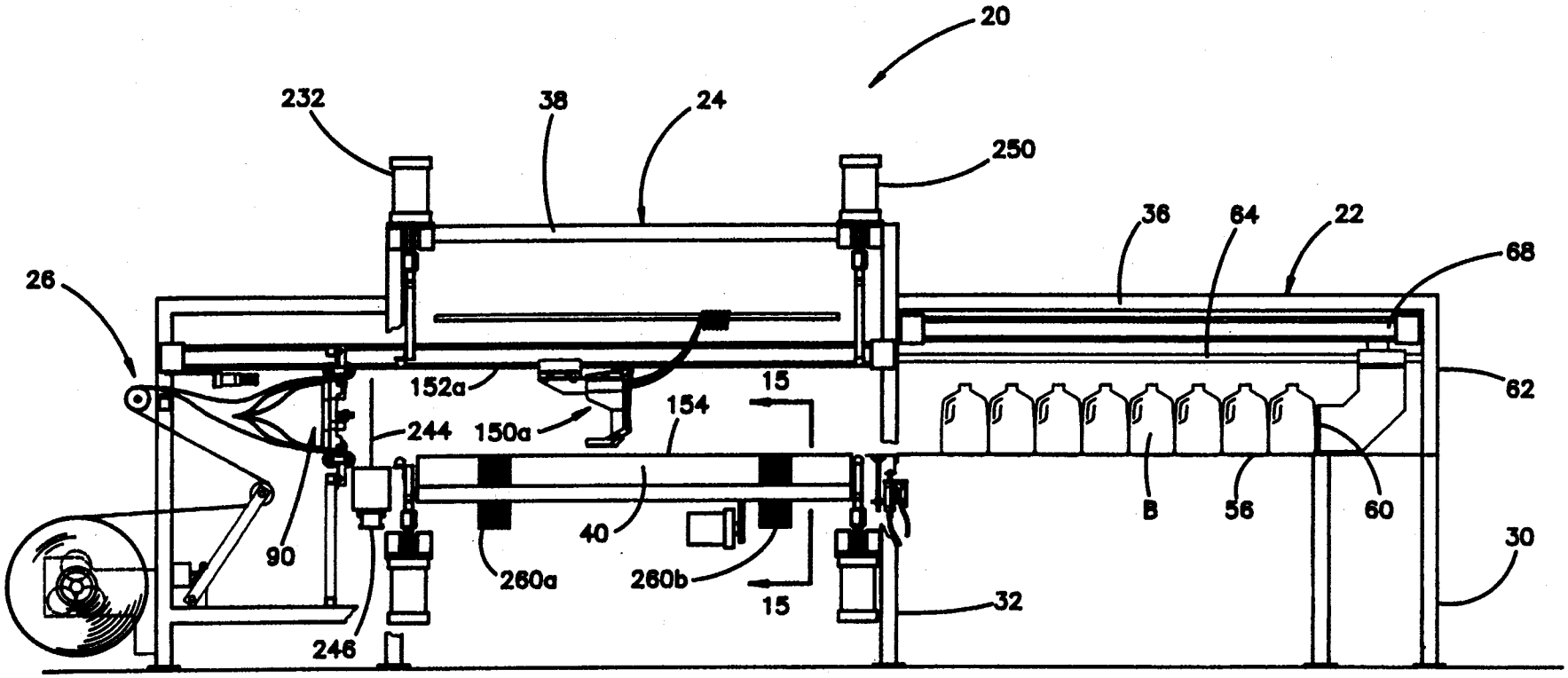
FIG. 2 is a side, elevational, sectional view taken substantially along the line 2—2 of FIG. 1.
Figure 3:
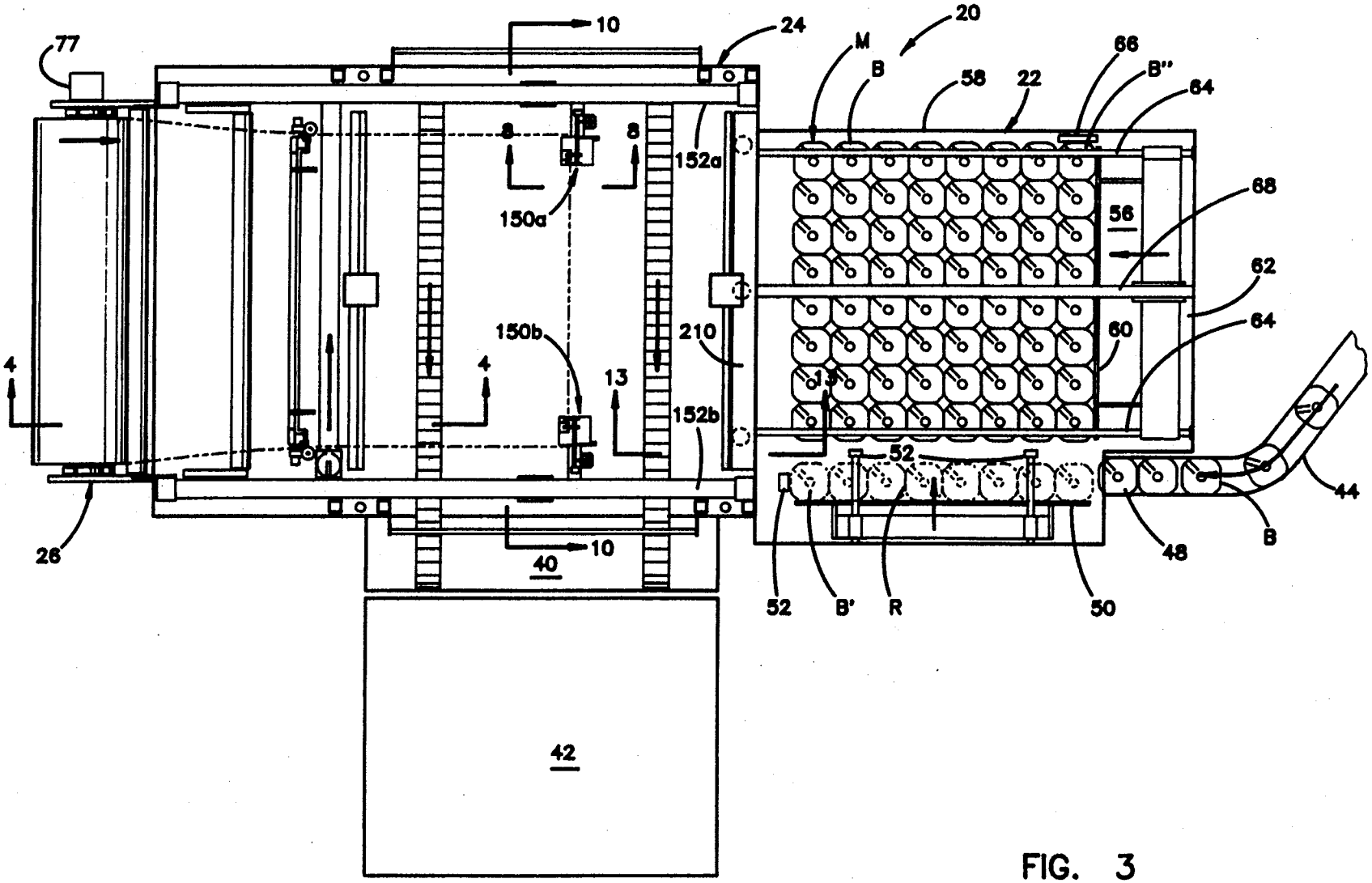
FIG. 3 is a top view of the apparatus of FIG. 1 with the upper protective enclosure removed.

By way of disclosing a preferred embodiment, and not by way of limitation, there is shown in FIGS. 1–3 a bottle bagging apparatus 20 which includes in its general organization a bottle collection station 22, a bottle bagging station 24, a plastic sleeve feeder 26, and an off-loading station 28. The apparatus is supported by appropriate legs and framework 30, 32, 34. The bottle collection station 22 is enclosed by a protective enclosure 36 and bagging station 24 is enclosed by protective enclosure 38. An inclined surface 40 leads laterally out of the bagging station 24 to an offloading platform 42. A chute 44 is connected at its upper end 46 to a supply of bottles. Bottles travel through the chute, 44 and are delivered serially, as shown at bottles B in FIG. 3, to the collection station 22 through opening 48.

The collection of bottles into a matrix is described with reference to FIG. 3. Bottles B pass serially toward the collection station 22 through chute 44. One by one, the bottles pass through the opening 48 and form a row R against a longitudinally oriented, reciprocating row pusher bar 50. Each arriving bottle advances the row toward a microswitch 52 at the end of the pusher bar 50 opposite the opening 48. When a full row of bottle has been accumulated against the row pusher bar 50, the endmost bottle B' contacts the microswitch 52.

Row pusher bar 50 is mounted for transverse movement on guide rods 54. Activation of microswitch 52 causes a suitable pneumatic cylinder to move the row pusher bar transversely to push the row of bottles onto a collection platform 56. Any rows of bottles already on the platform are pushed by the row R toward the far side 58 of the collection station. The row pusher bar 50 then retracts to its first position in readiness to accumulate another row of bottles. The collection of rows of bottles against the row pusher bar, pushing of the rows, and retraction of the row pusher bar repeats until a complete matrix of bottles B has been collected on the collection platform 56.

In the preferred embodiment illustrated in FIG. 3, a square matrix M of 8 rows of bottles, each row having 8 bottles, is shown. Other matrix sizes are possible within the scope of the invention.

As shown in FIGS. 2 and 3, matrix pusher bar 60 is disposed transversely across the outer end 62 of the collection station. Matrix pusher bar 60 is mounted for longitudinal reciprocating motion on guide rods 64. When a complete matrix M of bottles has been accumulated on the collection platform 56, one of the bottles B" contacts microswitch 66 situated at the far side 58 of the collection station. A pneumatic rodless cylinder 68, such as is available under the name "Tol-O-Matic," is mounted longitudinally across the central portion of the collection platform 56 and is connected to the matrix pusher bar 60. Activation of microswitch 66 activates rodless cylinder 68 to cause matrix pusher bar 60 to move longitudinally toward the bagging station 24. The movement of the matrix pusher bar 60 pushes the entire matrix M of bottles toward and into the bagging station where the matrix is bagged as described more fully below.

After the matrix pusher bar 60 pushes the matrix of bottles into the bagging station, the matrix pusher bar longitudinally retracts to its original position in readiness for collecting a second matrix of bottles on the collection platform 56.

Figure 4:
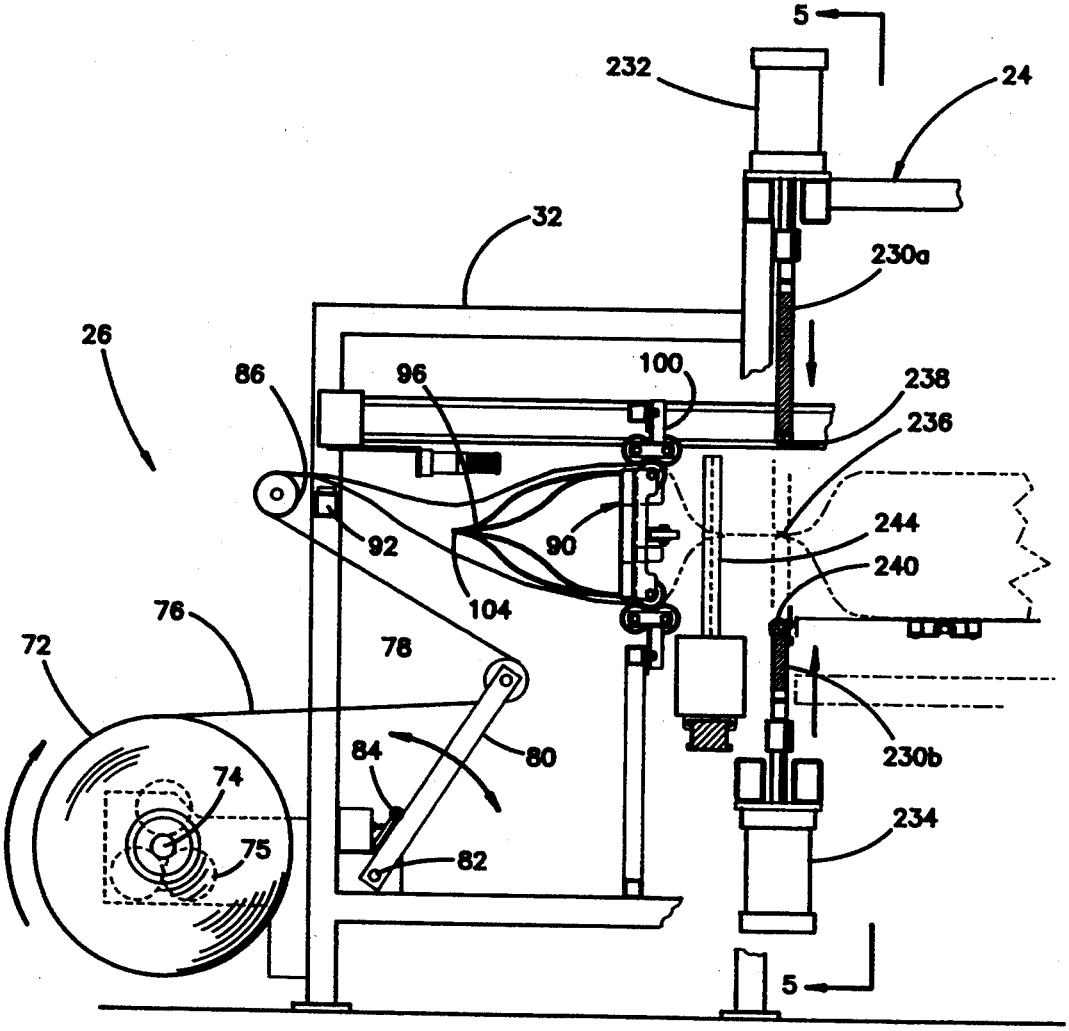
FIG. 4 is an enlarged, fragmentary, side elevational view of the sleeve feeder end of the apparatus taken substantially along the line 4—4 of FIG. 3.

Referring now to FIG. 4, which is enlarged view of one end of FIG. 2, the construction and operation of the sleeve feeder 26 may be described. A roll 72 of sleeve material 76 is supported for rotation on a spindle 74 transversely outwardly of the end of the bagging station 24 opposite the collection station 22. The ends of the spindle are supported on support rollers 75. A support roller 75 at one end of the spindle is rotatingly driven by a pneumatic motor 77 (FIG. 3).

Preferably, the sleeve 76 is of thin, flexible, airtight, plastic material, such as polyethylene. The sleeve is formed as a continuous web, with the wall of the sleeve collapsed and flattened against itself. The sleeve feeder 26 serves to uncoil the roll 72, open the collapsed sleeve wall so as to form a hollow sleeve, and to present the open end of the sleeve for being grasped and drawn into the bagging station as more fully described below.

The sleeve 76 is uncoiled from the roll 72 and passes forward under and around a transversely oriented tensioning roller 78. The ends of tensioning roller 78 are journalled to the upper ends of swing arms 80. The lower ends of swing arms 80 are mounted to pivots 82. The weight of the tensioning roller thus presses forward toward the bagging station 24 to maintain tension in the sleeve 76. A microswitch 84 is mounted near the lower extent of one of the swing arms 80. The sleeve passes upwardly and rearwardly from the tensioning roller and around a guide roller 86. From the guide roller 86, the sleeve 76 passes forwardly to a sleeve spreader 90.

The weight of the roll 72 of sleeve is such that mechanical assistance is required to uncoil the roll. When a section of sleeve is grasped and pulled into the bagging station, as described below, increased tension in the sleeve pulls on the tensioning roller 78 and causes the swing arms 80 to pivot rearwardly toward the roll 72. One of the swing arms then contacts and activates microswitch 84. Microswitch 84 activates pneumatic motor 77 (FIG. 3) which rotates one of the support rolls 75 to frictionally rotate the spindle 74 and cause the roll to uncoil. Uncoiling of the roll continues until enough sleeve is played out to allow the swing arms to move forwardly and deactivate microswitch 84. The pneumatic motor 77 is then deactivated and uncoiling stops.

From the guide roller 86 the sleeve 76 passes forward above a sensor 92. Sensor 92 detects the presence or absence of sleeve material. If sleeve material is absent, such as by exhaustion of the supply on the roll 72 or by malfunction, sensor 92 causes the bagging apparatus to halt operation.

From the guide roller 86, the sleeve 76 passes forward to the sleeve spreader 90. The construction of the sleeve spreader 90 is described with reference to FIGS. 4–7. In its general organization, the sleeve spreader 90 includes a spreader wedge 96, a spreader inner frame 98, and a spreader outer frame 100. The spreader wedge is preferably formed as an open framework of rigid wires 102. The wires are shaped so that a wedge is defining tapering to a rearward edge 104 directed toward the guide roller 86. The forward extents of the wires 102 are spread apart and are fixed to the spreader inner frame 98.

Figure 7:
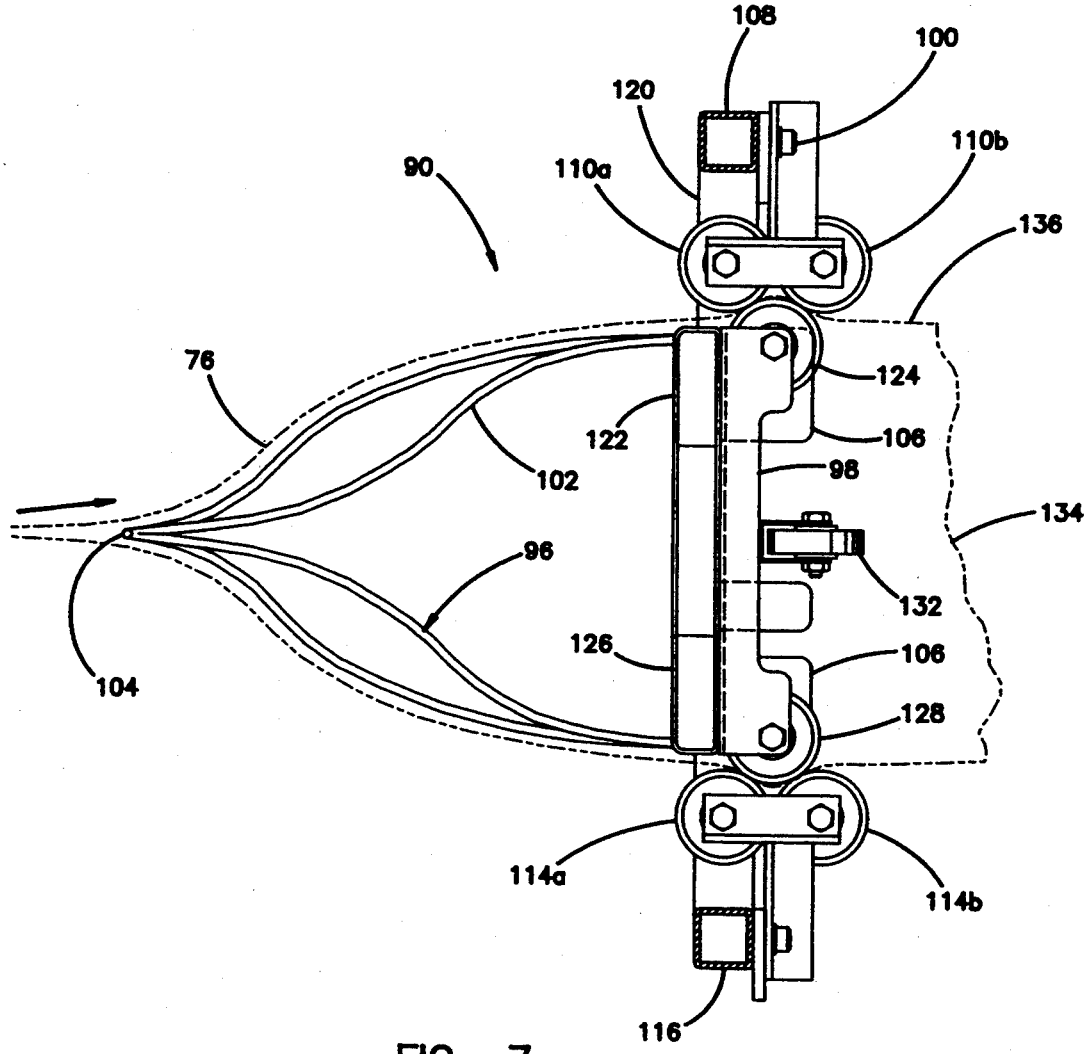
FIG. 7 is a sectional, elevational view taken substantially along the line 7—7 of FIG. 6 with the spreader and spreader support frame in assembled relationship.
Figure 8:
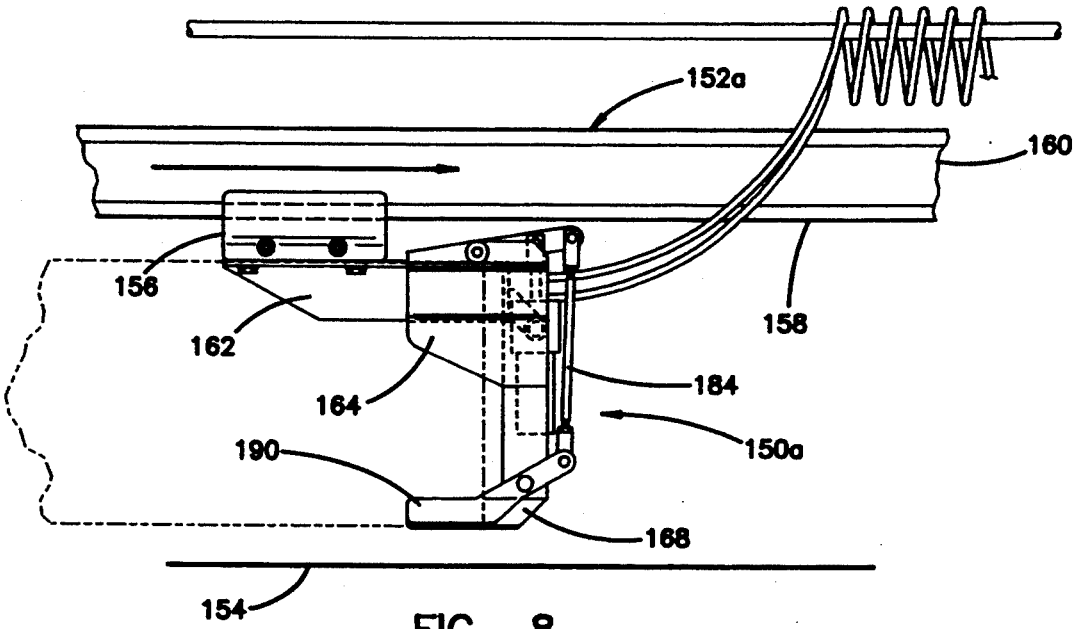
FIG. 8 is a fragmentary, side, elevational view taken substantially along the line 8—8 of FIG. 3 showing a grasper in a closed state.
Figure 9:
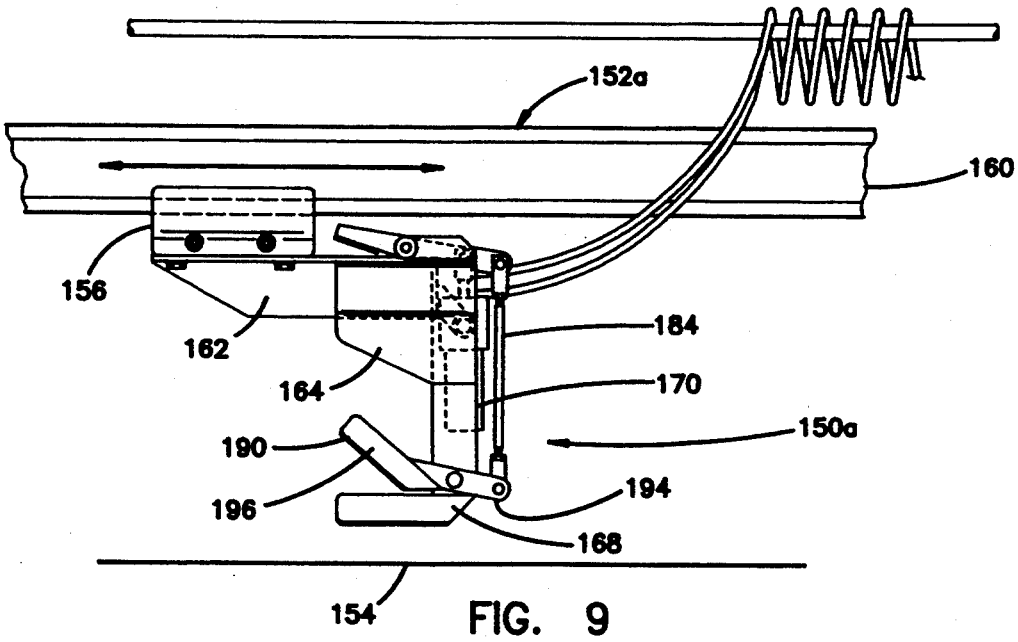
FIG. 9 is similar to FIG. 8 but shows the grasper in an open state.
Figure 10:
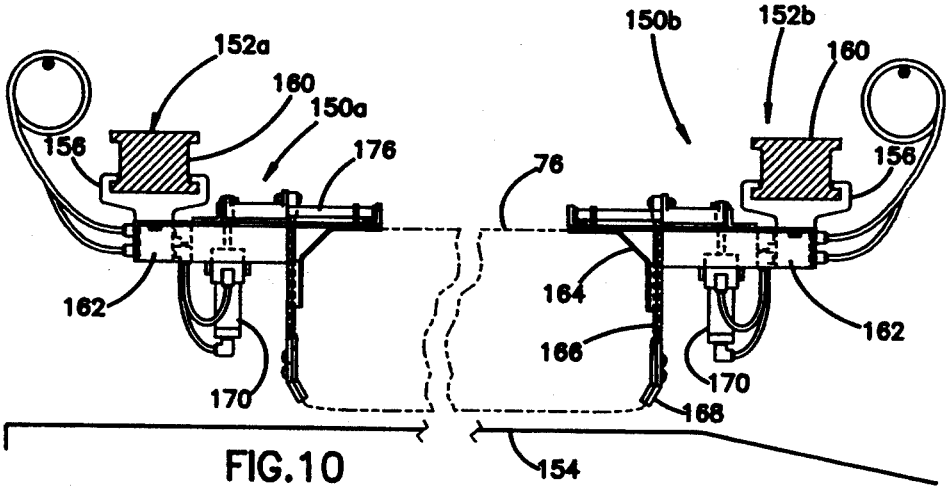
FIG. 10 is a front elevational view of the graspers taken substantially along the line 10—10 of FIG. 3.

The spreader inner frame 98 is a generally vertically disposed rectangular framework with beveled corners. The four corners of the spreader inner frame are provided with guides 106 which form a smooth surface over which the sleeve material passes. As shown in FIG. 7, the spreader wedge 96 and the spreader inner frame 98 are disposed within the advancing sleeve 76. As the sleeve 76 passes over the spreader wedge 96, the wall of the sleeve is uncollapsed so as to present an opening of a size and shape suitable to receive a matrix of bottles.

Figure 6:
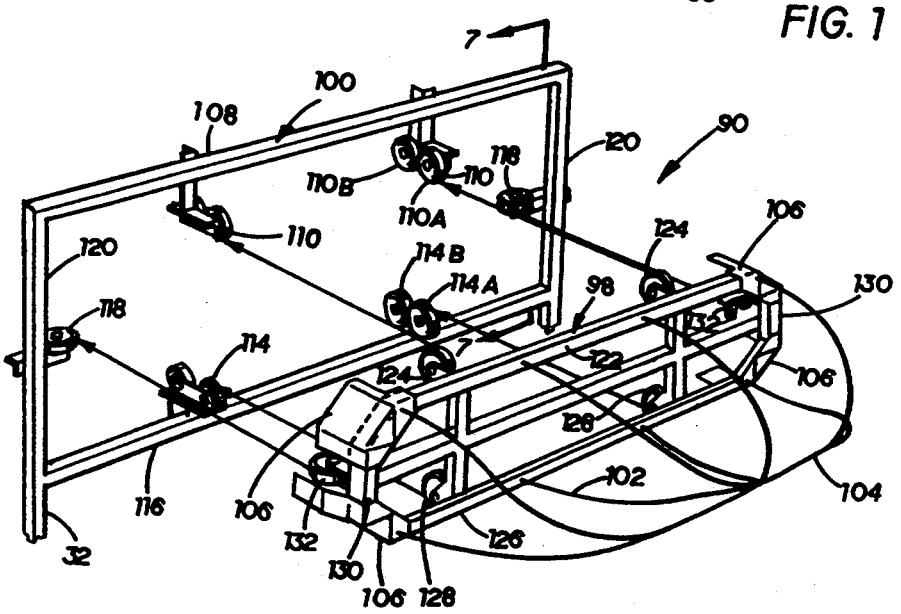
FIG. 6 is a perspective, exploded view of the spreader and spreader support frame.

As best shown in FIG. 6, the spreader outer frame 100 is a vertically disposed rectangular framework large enough to surround the perimeter of the spreader inner frame 98. The upper member 108 of the spreader outer frame is provided with two pair of upper rollers 110 which are disposed transversely spaced apart below the upper member 108 within the perimeter of the spreader outer frame. The upper rollers **110*a*, 110*b* are freewheeling and are mounted side by side with their axes of rotation extending generally transversely and spaced apart longitudinally. In a similar fashion, two pair of lower rollers 114, 114*a*, 114*b* are mounted to the lower member disposed above the lower member 116. A single roller 118 is mounted to each of the side members 120 of the spreader outer frame disposed within the opening of the spreader outer frame with their axes of rotation disposed vertically. The spreader outer frame 100 is fixed to the framework 32** of the bagging station.

The inner spreader frame 98 is provided with six single rollers in positions corresponding to the rollers of the outer spreader frame 100. The upper member 122 is provided with two upper rollers 124 disposed in correspondence with the outer frame upper rollers 110 and having a common axis of rotation disposed horizontally and transversely. Similarly, the lower member 126 is provided with two rollers 128 disposed in correspondence with the outer frame lower rollers 114. Each side member 130 is provided with a single side roller 132 disposed in correspondence with the outer frame side rollers 118 and having vertical axes of rotation.

When the spreader outer frame 100 and spreader inner frame 98 are assembled together, as best shown in FIG. 7, each of the upper rollers 124 of the inner frame fit below, between and adjacent to the upper rollers **110*a*, 110*b* of the outer frame. Similarly, each of the lower rollers 128 of the spreader inner frame fit above, between and adjacent to the lower rollers 114*a*, 114*b* of the outer frame. The inner frame side rollers 132 fit inwardly and adjacent to the outer frame side rollers 118 (see FIG. 5**).

With this arrangement, the upper and lower rollers 110, 114, 124, 128 establish and maintain the vertical and longitudinal position of the spreader inner frame 98 relative to the outer frame 100, the sleeve feeder 26, and the bagging station 24. Similarly, the side rollers 118 and 132 establish and maintain the transverse position of the spreader inner frame 98. However, there is no affixation of the spreader inner frame to the spreader outer frame 100. Therefore, as best shown in FIG. 7, a pathway is provided for the sleeve 76 to pass the sleeve spreader with the wall of the sleeve passing between the rollers 124, 128, and 132 of the inner frame and the rollers 110, 114, and 118 of the outer frame. The spreader wedge 96 is cantilevered rearwardly of the spreader inner frame 98 to expand the sleeve. As shown in FIG. 7, the leading end 134 when in a ready position is disposed a distance forwardly of the sleeve spreader 90 to provide a free end length 136 of sleeve which may be grasped by the graspers as described more fully below.

As shown in FIGS. 2 and 3, a pair of sleeve graspers **150*a*, 150*b* are disposed within the bagging station 24. The graspers are transversely spaced apart by a distance corresponding to the width of the opening of the leading edge 134 of the sleeve 76 (FIG. 7). The graspers are each mounted for reciprocating motion to a pneumatic rodless cylinder 152*a*, 152*b*. The function of the graspers is to move longitudinally toward the sleeve spreader 90, grasp the free end length 136 of the sleeve, then to move longitudinally away from the sleeve spreader 90 to draw a length of sleeve over the bagging platform 154** in readiness for a matrix of bottles to be pushed into the sleeve.

As shown in FIGS. 8–12, the graspers **150*a*, 150*b* are constructed identically but as mirror images of each other. Each grasper includes a follower 156 which engages the lower flange 158 of a pneumatic rodless cylinder beam 160 in a known manner. A bracket 162 is affixed to the underside of the follower 156. From the follower, the bracket extends-rearwardly toward the collection station 22 and transversely inwardly toward the opposite grasper. This rearward and inward cantilevering of the brackets 162 is provided to avoid interferences between or among the beams 160, sleeve spreader 90**, and the rear sealing jaws to be described below.

At the inner extent of each grasper bracket 162, there is affixed thereto a hand plate 164 which is shaped to fit within an upper corner of the sleeve free end length 136. The hand plate 164 extends forwardly of the bracket 162 so that the hand plate may be inserted into the sleeve without interference between the sleeve and the bracket. A leg 166 of the bracket 162 extends downwardly by a distance corresponding to the height of the opening at the free end of the sleeve. The lower extent of the leg 166 extends forwardly to form a first gripper finger 168.

A pneumatic cylinder 170 is mounted to each grasper bracket 162. The vertically extending shaft 172 of the cylinder is connected to a first crank arm 174 of a rod 176 extending transversely across the top of the bracket 162 journalled on bearings 178, 180. A second crank arm 182 affixed to the rod 176 extends generally longitudinally beyond the bracket leg 166. A link 184 extends downwardly from the end of the second crank arm 182.

The lower end of the link 184 is connected to a second gripper finger 190. Second gripper finger 190 is connected by a pivot 192 to the leg 166 of the bracket 162. The second gripper finger 190 has an arm portion 194 extending rearwardly from the pivot and connected to the lower end of the link 184. The second gripper finger has a finger portion 196 extending forwardly from the pivot 192. The finger portion 196 and the first gripper finger 168 are both slanted downwardly and inwardly.

In the closed, or gripping, position shown in FIGS. 8 and 10–12, the finger portion 196 overlies the first gripper finger 168 and is urged thereagainst by the force of the pneumatic cylinder 170 through the crank arms 174, 182, link 184, and 194. In the open, or releasing, position shown in FIG. 9, the shaft 172 of the cylinder 170 is retracted, thereby pivoting the finger portion 196 upward from the first gripper finger 168 and creating a gap therebetween in which the free end length 136 of the sleeve may be received.

A gripper foot 200 is fixed to each of the rods 176 near the inner ends of the rods. When the shaft 172 of the cylinder 170 is extended in the closed, or gripping, position as shown in FIGS. 8 and 10–12, the gripper foot 200 is urged against the upper horizontal surface 202 of hand plate 164. When the shaft 172 is retracted in the open, or releasing, position shown in FIG. 9, gripper foot 200 is pivoted upward from the upper surface 202 of the hand plate to create a gap therebetween in which the free end length 136 of the sleeve may be received. Thus, the interconnection of the gripper foot 200 and second gripper finger 190 by the link 184 and rod 176 is such that the gripper foot and second gripper finger open and close in tandem upon the retraction and extension of the shaft 172 of cylinder 170. Furthermore, the graspers are configured to hold the end of the sleeve open in readiness to have a matrix of bottles pushed into the sleeve.

Figure 11:
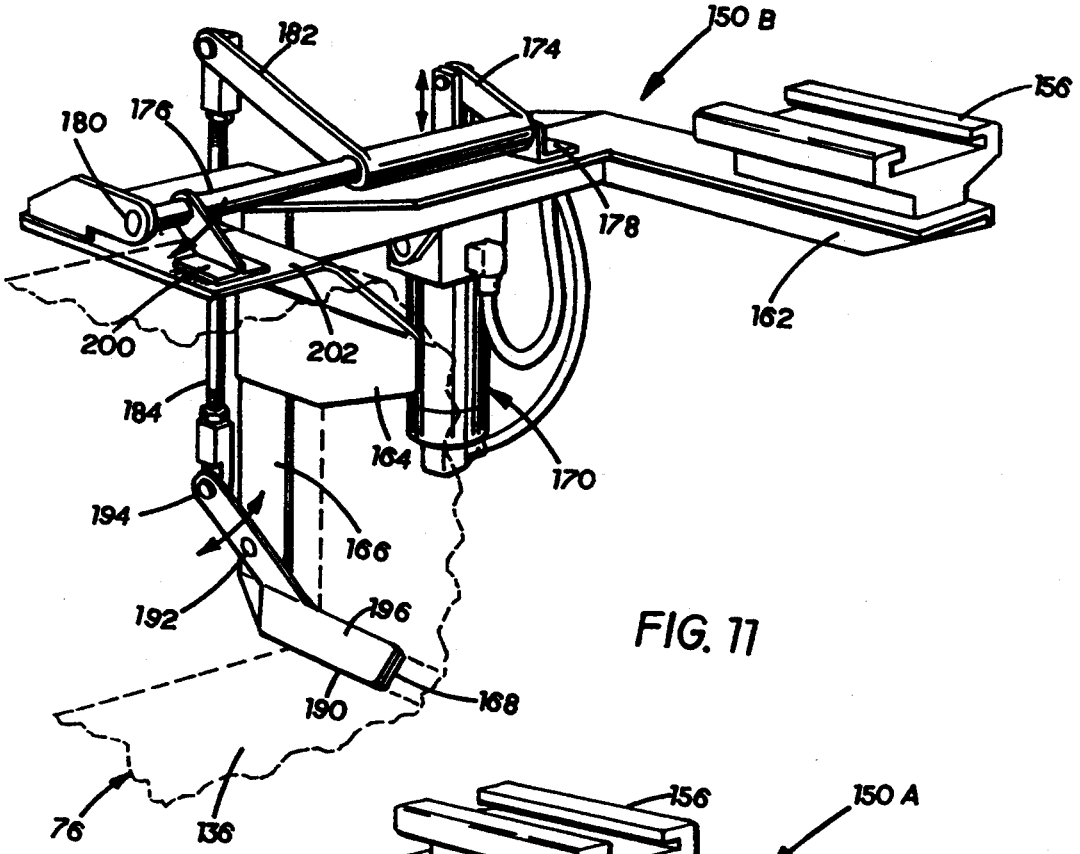
FIG. 11 is a front and side perspective view of a grasper.
Figure 12:
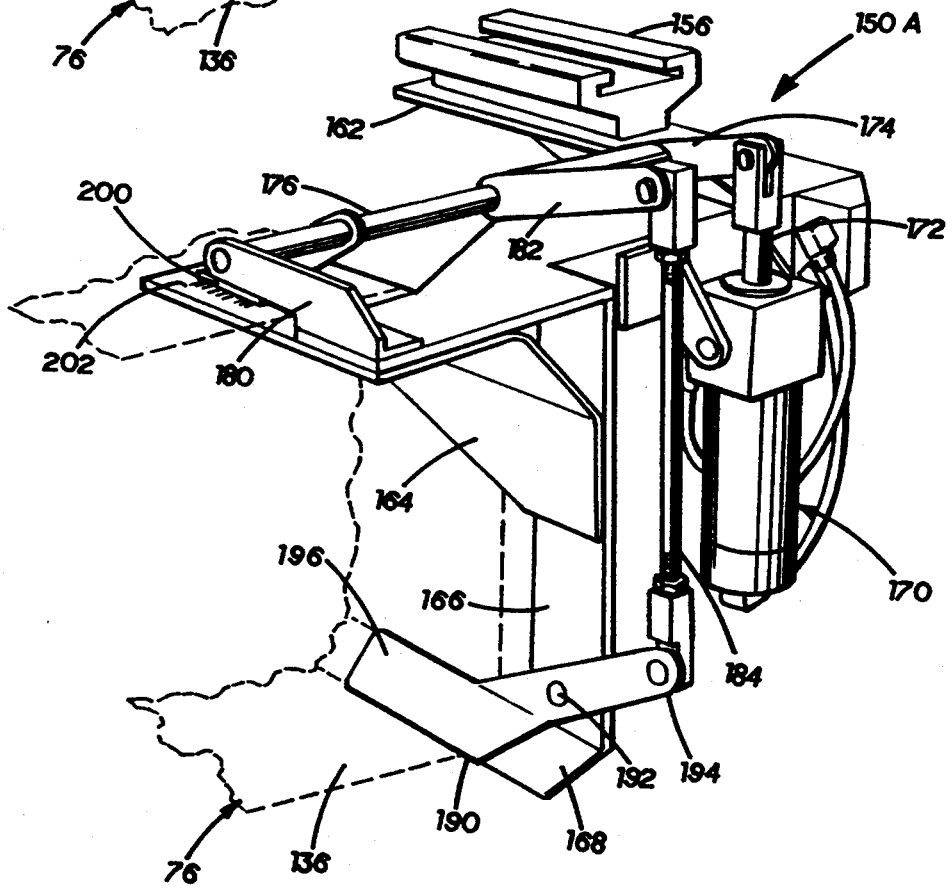
FIG. 12 is a rear and side perspective view of a grasper.

In operation, with the free end portion 136 of the sleeve disposed forwardly of the spreader frame 90 as shown in FIG. 7, the graspers **150*a*, 150*b* are moved simultaneously toward the spreader frame by the action of linear bearings 152*a*, 152*b*. As the graspers approach the sleeve end, the cylinder shaft 172 is retracted to open the gripper foot 200 and second gripper finger 190 of each grasper. The free end portion 136 of the sleeve is received between the gripper foot 200 and hand plate upper surface 202, and ]between the first and second gripper fingers 168, 190 of each grasper. The shaft 172 of the cylinder is then extended to close each gripper foot 200 and second gripper finger 200, thereby grasping the free end portion 136 of the sleeve as shown in FIGS. 11 and 12**.

After the sleeve has been grasped by the graspers **150*a*, 150*b*, linear bearings 152*a*, 152*b* are activated to move the graspers longitudinally through the bagging station 24 toward the collection station 22**. This draws an open ended section of sleeve into the bagging station.

Figure 13:
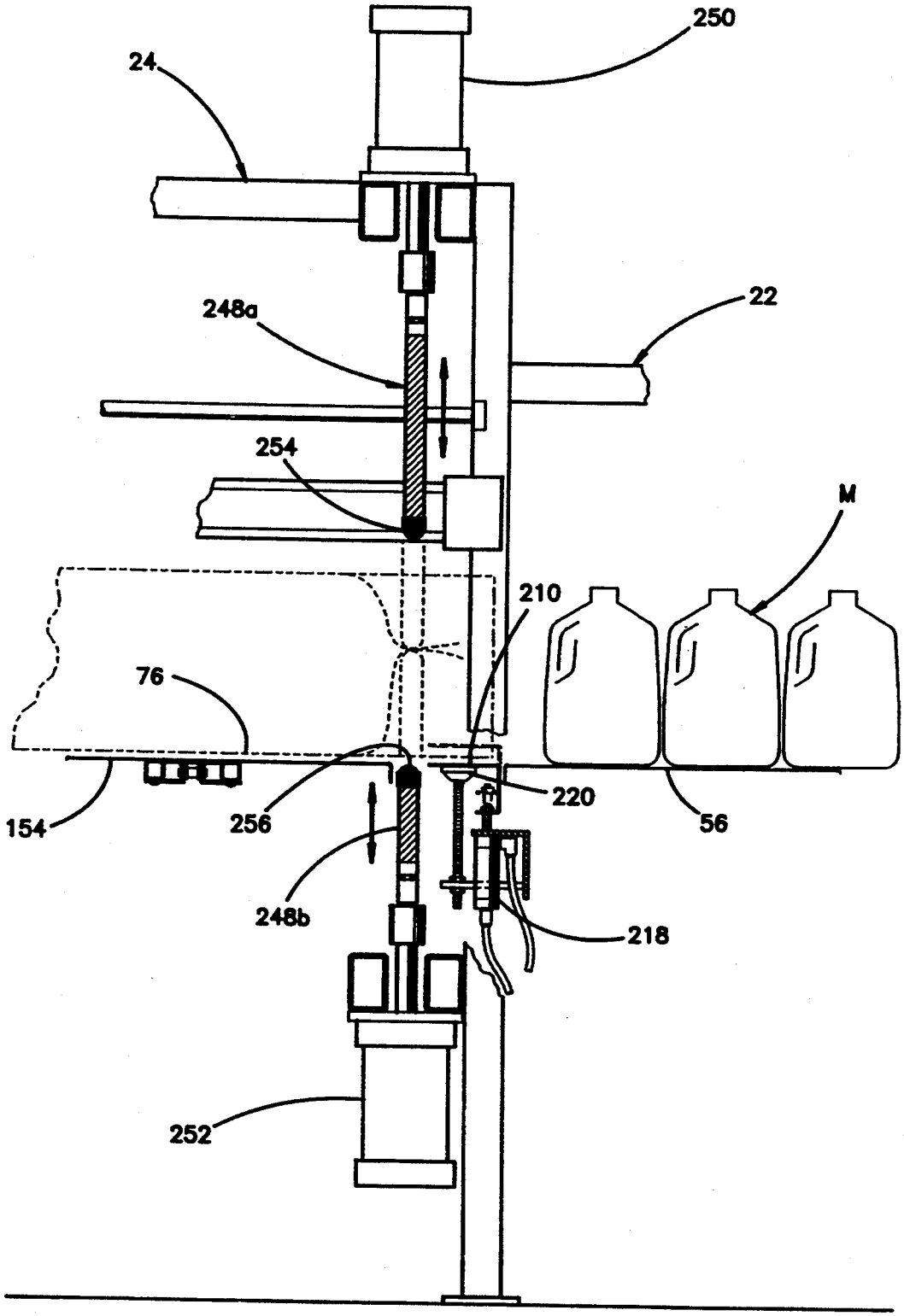
FIG. 13 is an enlarged, fragmentary, side elevational view of the collection platform and lip bar end of the apparatus taken substantially along the line 13—13 of FIG. 3.
Figure 14:
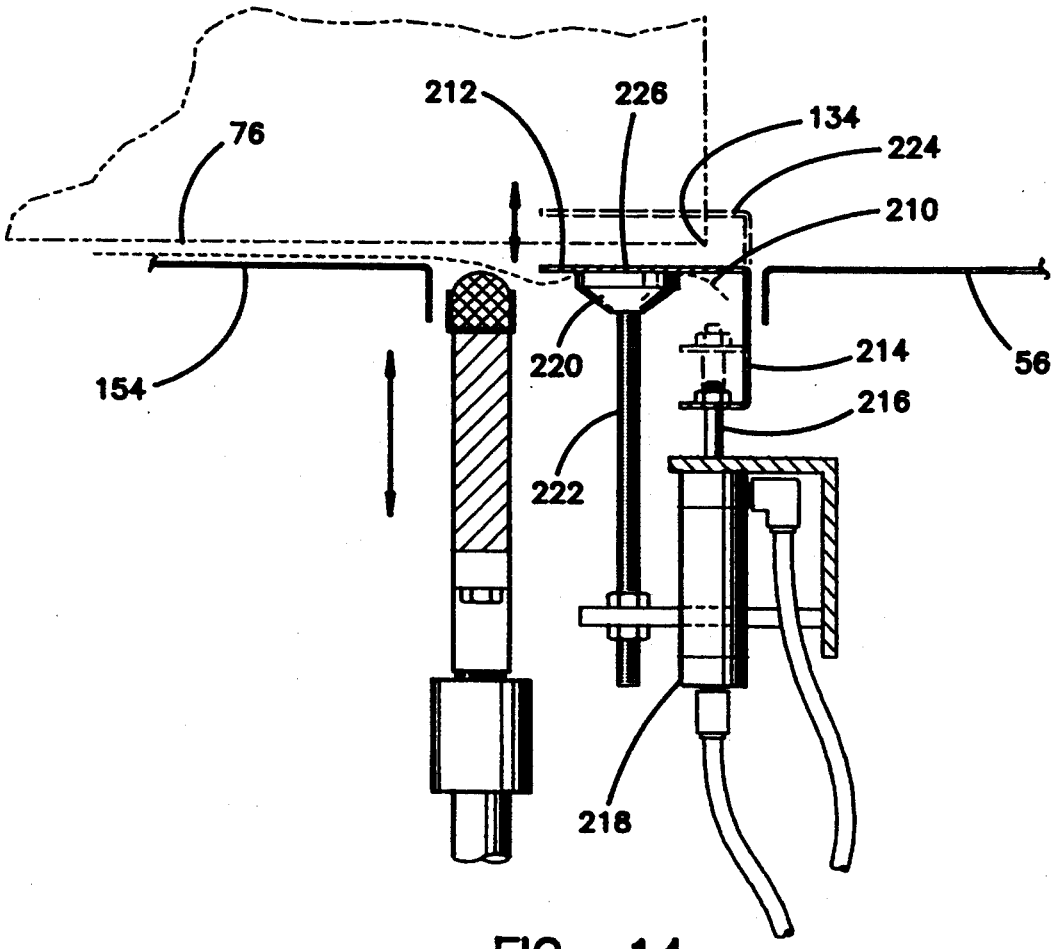
FIG. 14 is an enlarged, fragmentary, side elevation view of the lip bar and the adjacent lower sealing jaw.

As shown in FIGS. 3, 13, and 14, a lip bar 210 extends transversely across the edge of the bagging platform 154 adjacent the collection platform 56. The purpose of the lip bar 210 is to engage the lower horizontally extending extent of the sleeve leading end 134 and retract it downwardly so as to form a flush horizontal surface bridging the bagging platform 154 and the collection platform 56 and to form an opening in the sleeve end into which the matrix M of bottles may be pushed without interference.

As best shown in FIGS. 13 and 14, lip bar 210 is formed as an elongated member having a generally L-shaped cross section. A horizontal leg 212 extends toward the bagging platform 154. A vertical leg 214 extends downwardly from the edge of the horizontal leg 212 nearest the collection platform 56. The lower extent of the vertical leg 214 is affixed to the shafts 216 of two, transversely spaced apart pneumatic cylinders 218. Stops 220 are mounted below the horizontal leg 212 of the lip bar. Stops 220 are mounted to the upper ends of threaded rods 222 which are used to adjust the stops to the correct vertical position.

When the sleeve 76 is being drawn by the graspers 150 through the bagging station 24 toward the collection station 22, the shafts 216 are extended so that the lip bars are in the raised position shown at 224 in FIG. 14. The lower extent of the leading end 134 of the sleeve 76 between the graspers enters the gap between the lip bar horizontal leg 212 and the stops 220 at which point the movement of the graspers toward the collection station 56 halts. Then, the shafts 216 of the cylinders 218 are retracted so that the lip bars descend to the position shown at 226. In this position, the sleeve is clamped between the lip bar 210 and the stops 220. The horizontal leg 212 of the lip bar is disposed substantially in a common plane with the collection platform 56 and the bagging platform 154 in readiness for a matrix of bottles to be pushed into the end opening of the sleeve.

Figure 5:
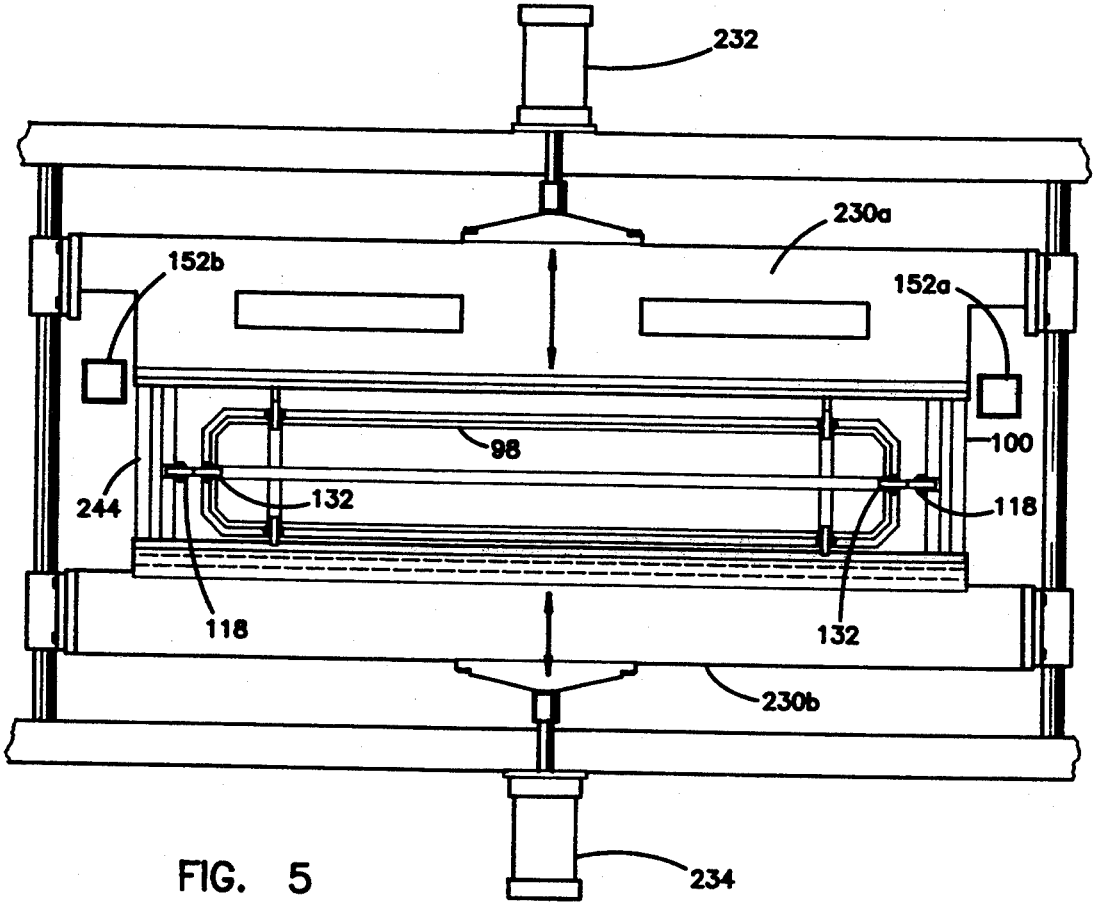
FIG. 5 is a sectional, elevational view taken along the line 5—5 of FIG. 4.

After the sleeve has been drawn by the graspers into the bagging station, the lip bar has pulled down the lower extent of the sleeve open end, and a matrix of bottles has been pushed from the collection platform into the sleeve, the sleeve must be sealed off and severed to form a bagged lot. As best shown in FIGS. 4 and 5, a first pair of sealing jaws **230*a*, 230*b* is provided extending transversely between the bagging station 24 and the spreader frame 90. Pneumatic cylinder 232 is activated to cause upper sealing jaw 230*a* to descent while at the same time pneumatic cylinder 234 is activated to cause lower sealing jaw 230*b* to rise. The jaws 230*a*, 230*b* meet as shown at 236 in FIG. 4 clamping the sleeve 76 between the edges 238, 240 of the jaws. The edges 238 and 240** are heated in a known manner, such as by electrical resistance, thereby causing the sleeve to fuse to itself and form a first sealed edge for the bag.

While the sleeve is claimed between the first pair of sealing jaws **230*a*, 230*b*, a heated cutting wire 244 on a linear pneumatic rodless cylinder 246 (FIG. 2) moves transversely across the sleeve between the jaws 230*a*, 230*b* and the spreader frame 90** to sever the sleeve and form a flap end for the bag. The cutting wire then travels back to its original position.

As shown in FIGS. 13 and 14, a second pair of sealing jaws **248*a*, 248*b* is provided transversely between the edge of the bagging platform 154 and the lip bar 210 and are provided with pneumatic cylinders 250, 252 and heated edges 254, 256. After a matrix of bottles has been pushed into the sleeve, and simultaneously with the sealing of the other end of the bag by the first pair of sealing jaws, the second pair of sealing jaws 248*a*, 248*b* seals off the sleeve to create an end flap in a manner similar to the first pair of sealing jaws. As the jaws 248*a* and 248*b* approach each other, lip bar 210** is raised and the fingers and gripper feet of the graspers are opened to allow the sleeve end to be sealed.

Figure 15:
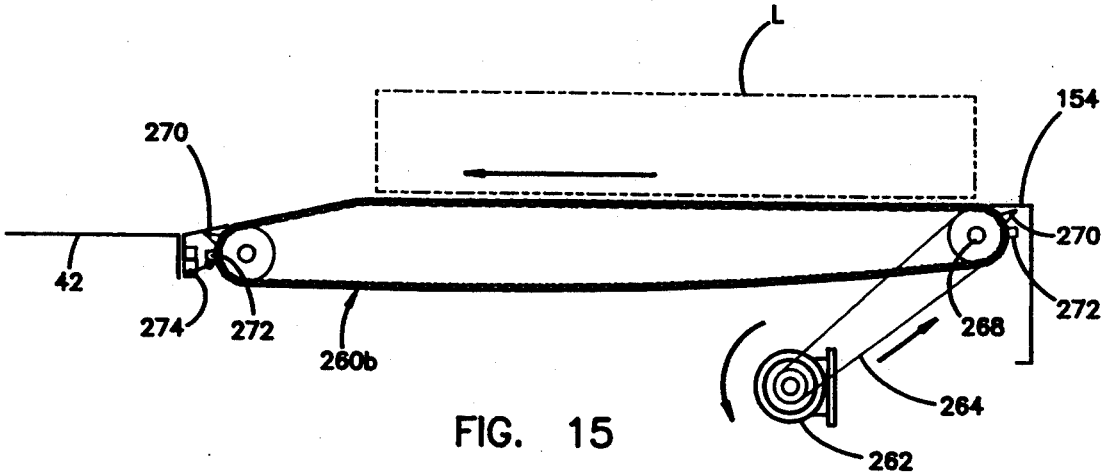
FIG. 15 is an end, sectional view taken substantially along the line 15—15 of FIG. 2.

After the ends of the sleeve have been sealed and a bagged lot of bottles severed from the sleeve, the bagged lot is ejected from the bagging station onto the offloading platform 42. As shown in FIGS. 2 and 15, the ejection of a bagged lot is accomplished by a pair of conveyors 260*a*, 260*b* which extend transversely across the surface of the bagging platform 154. A pneumatic motor 262 connected by belt 264 to a pulley and common shaft 268 arrangement causes the upper run of the conveyors to advance toward the offloading platform 42. Each conveyor has a pair of cleats 270 which extend outwardly from the conveyor to engage and push the side of the bagged lot L. Conveyor 260*b* is provided with a pair of lugs 272 which engage a microswitch 274 to signal that the conveyors have been advanced the correct distance.

As those familiar with the art will appreciate, the bottle bagging apparatus is provided with suitable electrical and pneumatic systems for energizing and controlling the various components of the apparatus.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. An apparatus for bagging bottles comprising:

a platform;

means for drawing a collapsed, continuous flexible sleeve in a longitudinal direction over said platform;

means for spreading and opening said flexible sleeve as the sleeve is drawn in the longitudinal direction past the means for spreading and opening to form an open sleeve having a sleeve end opening;

means for moving a matrix of bottles having longitudinally opposite ends into said open sleeve through said sleeve end opening, while said sleeve is held open by said means for drawing, whereby the matrix of bottles rests on said platform;

means for sealing said sleeve adjacent the longitudinally opposite ends of said matrix of bottles while the bottles are on said platform so as to form a bag containing said bottles; and means for severing said bag from said sleeve while the bottles are on said platform;

wherein said sleeve is sealed and said bag is severed from said sleeve after the matrix of bottles is moved into said sleeve and prior to subsequent movement of the matrix of bottles.

2. The apparatus of claim 1 wherein said means for spreading comprises an inner spreader frame disposed within said sleeve.

3. The apparatus of claim 2 wherein said means for spreading further comprises an outer spreader frame disposed outwardly surrounding said inner spreader frame and supporting said inner frame without affixation between said inner spreader frame and said outer spreader frame, said sleeve passing between said inner spreader frame and said outer spreader frame.

4. The apparatus of claim 1 wherein said means for drawing comprises a longitudinally moving grasper means for grasping and pulling an end of said sleeve to feed out a section of said sleeve.

5. The apparatus of claim 1 further comprising a means for collecting a plurality of bottles seriatim and arranging said bottles into a matrix, and wherein said means for moving a matrix comprises a pusher means for pushing said matrix from said means for collecting into said sleeve.

6. The apparatus of claim 1 further comprising means for moving said severed bag to an offloading station.

7. A bottle bagging apparatus comprising:

means for supporting and unrolling a continuous, collapsed, flexible sleeve in a longitudinal direction;

means for uncollapsing and opening the sleeve as the sleeve is unrolled to form an open sleeve having an open leading sleeve end, said open leading sleeve end having a lower extent and an upper extent and two opposite sides;

means for grasping and releasing the open leading sleeve end, said means for grasping mounted for longitudinal reciprocating movement toward and away from said means for uncollapsing and opening, whereby said means for grasping moves toward said means for uncollapsing and opening, grasps the open leading sleeve end, moves away from said means for uncollapsing and opening to feed out a length of sleeve from which a bag will be formed, supports the open leading sleeve end while a matrix of bottles is moved through the open leading sleeve end into the length of sleeve, and releases the leading sleeve end;

a first platform disposed below said means for grasping, said means for grasping feeding out the length of open sleeve longitudinally across said first platform;

matrix means for arranging bottles into a matrix on said first platform;

means for moving the matrix of bottles through the open leading sleeve end into the length of open sleeve after the length of sleeve is fed out across said first platform;

first means for sealing said open sleeve end after the matrix of bottles has moved into the length of sleeve and while the bottles are on said first platform;

second means for sealing said open sleeve between the matrix of bottles and said means for uncollapsing and opening and while the bottles are on said first platform; and means for severing the bagged matrix of bottles from said sleeve while the bottles are on said platform thereby forming a bagged lot of bottles supported atop said first platform;

wherein said sleeve is sealed and said bag is severed from said sleeve after the matrix of bottles is moved into said sleeve and prior to subsequent movement of the matrix of bottles.

8. The apparatus of claim 7 further comprising means for conveying the bagged lot of bottles from said first platform.

9. The apparatus of claim 8 wherein said means for conveying comprises conveyors extending across said first platform in a direction transverse to the longitudinal direction.

10. The apparatus of claim 7 wherein said means for uncollapsing comprises an inner spreader means and an outer spreader means, said outer spreader means supporting said inner spreader means without physical affixation therebetween whereby a path between said outer spreader means and said inner spreader means is defined through which the sleeve passes without obstruction, said inner spreader means disposed within said sleeve.

11. The apparatus of claim 10 wherein said inner spreader means includes a wedge means having an edge extending upstream into said sleeve.

12. The apparatus of claim 10 wherein said inner spreader means and said outer spreader means each include a plurality of rollers, the rollers of said inner spreader means disposed in rolling engagement with said rollers of said outer spreader means, said path being defined between said rollers of said inner spreader means and the rollers of said outer spreader means.

13. The apparatus of claim 7 wherein said means for grasping and releasing comprises first and second graspers disposed transversely spaced apart and configured to maintain said open leading sleeve end in an open condition.

14. The apparatus of claim 13 wherein each of said first and second graspers comprises a hand plate means adapted to extend within the open leading end of the sleeve and maintain the open leading end in an open condition and a gripper means movable between a closed position for gripping the sleeve against the hand plate means and an open position for releasing the sleeve.

15. The apparatus of claim 13 wherein each of said first and second graspers comprises a first gripper finger and a second gripper finger, said second gripper finger movable between a closed position for gripping the sleeve against the first gripper finger and an open position for releasing the sleeve.

16. The apparatus of claim 15 wherein said first and second gripper fingers of said first and second graspers are disposed at the opposite sides of the lower extent of said sleeve.

17. The apparatus of claim 13 further comprising a lip means disposed transversely across said first platform extending between said first and second graspers, said lip means being movable between a raised position and a lowered position, whereby when said graspers feed out a length of the sleeve, the lower extent of the sleeve extending transversely between said graspers is received below said lip means while said lip means is in said raised position, said lip means thereafter being moved to said lowered position to pull the lower extent of the sleeve downward and form an unobstructed opening through which the matrix of bottles may move into the sleeve.

18. The apparatus of claim 18 further comprising stop means disposed below said lip means, whereby the lower extent of the sleeve is clamped between said stop means and said lip means upon movement of said lip means to said lowered position.

19. The apparatus of claim 18 wherein said matrix means comprises a bottle collection means for collecting a plurality of bottles and arranging said bottles into a matrix, said bottle collection means comprising a second platform disposed adjacent said first platform longitudinally opposite said means for uncollapsing.

20. The apparatus of claim 19 wherein said means for moving a matrix of bottles comprises a pusher bar for pushing a matrix of bottles on said second platform into said sleeve open end on said first platform.

21. The apparatus of claim 7 wherein said first means for sealing comprises a pair of sealing jaws movable from an open position to a closed position in which said sleeve is clamped between said jaws.

22. The apparatus of claim 21 wherein each of said sealing jaws includes a heated edge for sealing said sleeve.

23. The apparatus of claim 7 wherein said means for severing comprises a cutting wire movable transversely across said sleeve.

24. A bottle bagging apparatus comprising:

means for collecting bottles and arranging bottles into a matrix, said means for collecting bottles including a collection platform upon which the matrix is supported;

a bagging platform disposed adjacent said collection platform;

means for drawing a continuous, collapsed, flexible sleeve in a longitudinal direction, said means for drawing disposed longitudinally adjacent said bagging platform opposite said collection platform;

means for continuously opening said sleeve as said sleeve is drawn in the longitudinal direction so as to form an open sleeve having an open sleeve end, said open sleeve end having a lower extent and an upper extent and two opposite sides;

said means for drawing including longitudinally reciprocating grasper means for grasping said open sleeve end and drawing a section of the sleeve across said bagging platform toward said collection platform;

means for longitudinally pushing the matrix of bottles from said collection platform onto said bagging platform and through said open sleeve end into said open sleeve while said sleeve is held by said grasper means;

first means for sealing said open sleeve end after said matrix of bottles is in said sleeve and while the matrix is on said bagging platform;

second means for sealing said sleeve opposite said open sleeve end while the matrix is on said bagging platform to form a bag from said section of sleeve in which said matrix of bottles is enclosed;

means for severing the bag from the remainder of the sleeve while the matrix is on said bagging platform; and means for conveying said bag off of said bagging platform;

wherein said sleeve is sealed and said bag is severed from said sleeve and onto said bagging platform after the matrix of bottles is pushed into said sleeve and prior to subsequent movement of the matrix of bottles.

25. The apparatus of claim 24 wherein said means for conveying comprises conveyors extending across said bagging platform in a direction transverse to the longitudinal direction.

26. The apparatus of claim 24 wherein said means for continuously uncollapsing comprises an inner spreader means and an outer spreader means, said outer spreader means supporting said inner spreader means without physical affixation therebetween whereby a path between said outer spreader means and said inner spreader means is defined through which the sleeve passes without obstruction, said inner spreader means disposed within said sleeve.

27. The apparatus of claim 26 wherein said inner spreader means includes a wedge means having an edge extending upstream into said sleeve.

28. The apparatus of claim 26 wherein said inner spreader means and said outer spreader means each include a plurality of rollers, the rollers of said inner spreader means disposed in rolling engagement with said rollers of said outer spreader means, said path being defined between said rollers of said inner spreader means and the rollers of said outer spreader means.

29. The apparatus of claim 24 wherein said grasper means comprises first and second graspers disposed transversely spaced apart and configured to maintain said open leading sleeve end in an open condition.

30. The apparatus of claim 29 wherein each of said first and second graspers comprises a hand plate means adapted to extend within the open leading end of the sleeve and maintain the open leading end in an open condition and a gripper means movable between a closed position for gripping the sleeve against the hand plate means and an open position for releasing the sleeve.

31. The apparatus of claim 29 wherein each of said first and second graspers comprises a first gripper finger and a second gripper finger, said second gripper finger movable between a closed position for gripping the sleeve against the first gripper finger and an open position for releasing the sleeve.

32. The apparatus of claim 31 wherein said first and second gripper fingers of said first and second graspers are disposed at the opposite sides of the lower extent of said sleeve.

33. The apparatus of claim 29 further comprising a lip bar means for pulling down the lower extent of said sleeve, said lip bar means extending transversely between said bagging platform and said collection platform and between said first and second graspers, said lip means being movable between a raised position and a lowered position, whereby when said graspers feed out a length of the sleeve, the lower extent of the sleeve extending transversely between said graspers is received below said lip means while said lip means is in said raised position, said lip means thereafter being moved to said lowered position to pull the lower extent of the sleeve downward and form an unobstructed opening through which the matrix of bottles may move from the collection platform onto the bagging platform and into the sleeve.

34. The apparatus of claim 33 further comprising stop means disposed below said lip means, whereby the lower extent of the sleeve is clamped between said stop means and said lip means upon movement of said lip means to said lowered position.

35. The apparatus of claim 24 wherein said first and second means for sealing each comprise a pair of sealing jaws movable from an open position to a closed position in which said sleeve is clamped between said jaws.

36. The apparatus of claim 35 wherein each of said sealing jaws includes a heated edge for sealing said sleeve.

37. The apparatus of claim 24 wherein said means for drawing comprises means for supporting a roll of said flexible sleeve and means for unrolling said roll.

38. The apparatus of claim 37 wherein said means for unrolling comprises a spindle supporting said roll, at least one support roller supporting said spindle, and a motor means for causing said roller to rotate and thereby unroll said roll.

39. The apparatus of claim 38 wherein said means for unrolling operates in response to said grasper means drawing a section of said sleeve.

* * * * *

UNITED STATES PATENT AND TRADEMARK OFFICE

CERTIFICATE OF CORRECTION

PATENT NO. : 5,426,922

DATED : June 27, 1995

INVENTOR(S) : Jerry A. Bott et al

It is certified that error appears in the above-indentified patent and that said Letters Patent is hereby corrected as shown below:

Column 7, line 48:
"]between" should be --between--

Column 11, claim 18, line 50:
"18" should be --17--

Signed and Sealed this

Second Day of January, 1996

Bruce Lehman

*Attest:*

BRUCE LEHMAN

*Attesting Officer*

*Commissioner of Patents and Trademarks*